US009567201B2

(12) United States Patent
Seo et al.

(10) Patent No.: US 9,567,201 B2
(45) Date of Patent: Feb. 14, 2017

(54) REFRIGERATOR

(71) Applicant: LG ELECTRONICS INC., Seoul (KR)

(72) Inventors: Woonkyu Seo, Seoul (KR); Jaeyoung Kim, Seoul (KR); Daesung Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 106 days.

(21) Appl. No.: 14/692,363

(22) Filed: Apr. 21, 2015

(65) Prior Publication Data

US 2015/0300729 A1 Oct. 22, 2015

(30) Foreign Application Priority Data

Apr. 21, 2014 (KR) ..... 10-2014-0047747

(51) Int. Cl.

| | |
|---|---|
| ***F25D 23/04*** | (2006.01) |
| ***B67D 3/02*** | (2006.01) |
| ***B67D 1/08*** | (2006.01) |
| ***F25D 23/12*** | (2006.01) |
| ***B67D 3/00*** | (2006.01) |
| *B67D 1/00* | (2006.01) |

(52) U.S. Cl.

CPC ..... *B67D 1/0858* (2013.01); *B67D 3/0009* (2013.01); *B67D 3/0025* (2013.01); *B67D 3/0077* (2013.01); *F25D 23/126* (2013.01); *B67D 2001/0087* (2013.01); *B67D 2210/00049* (2013.01)

(58) Field of Classification Search

CPC ... B67D 1/0858; B67D 3/0009; B67D 3/0077; B67D 3/0025; B67D 2210/00049; B67D 2001/0087; F25D 23/126

USPC ..... 141/82, 98, 192–193, 351, 360; 62/3.64, 62/389

See application file for complete search history.

(56) References Cited

U.S. PATENT DOCUMENTS

| | | | | |
|---|---|---|---|---|
| 7,757,732 | B2 * | 7/2010 | Voglewede | F25D 23/126 141/18 |
| 7,793,690 | B2 * | 9/2010 | Voglewede | F25D 23/126 141/360 |
| 8,967,432 | B2 * | 3/2015 | Bertolini | B67D 7/82 222/146.2 |
| 9,139,415 | B2 * | 9/2015 | Hall | B67D 7/82 |
| 9,216,895 | B2 * | 12/2015 | Bertolini | B67D 7/82 |
| 2010/0175415 | A1 * | 7/2010 | Kim | F25D 23/126 62/389 |
| 2014/0270724 | A1 * | 9/2014 | Hall | B67D 7/82 392/341 |
| 2014/0270725 | A1 * | 9/2014 | Bertolini | B67D 7/82 392/341 |
| 2015/0136803 | A1 * | 5/2015 | Bertolini | B67D 7/82 222/1 |

(Continued)

*Primary Examiner* — Nicholas A Arnett

(74) *Attorney, Agent, or Firm* — Fish & Richardson P.C.

(57) ABSTRACT

A refrigerator includes a main body, a storage space defined within the main body, a door configured to open and close at least a portion of the storage space, a dispenser provided in the door and defining a space in which water is dispensed, a water nozzle extending downward into the space, where the water nozzle is movably mounted at the dispenser and configured to dispense water, a manipulation detection device provided at the dispenser, the manipulation detection device being configured to detect movement of the water nozzle, and a control unit configured to open and close a water supply valve connected to the water nozzle according to a detection signal generated by the manipulation detection device.

25 Claims, 14 Drawing Sheets

(56) References Cited

U.S. PATENT DOCUMENTS

2015/0276293 A1* 10/2015 Seo ..... F25D 23/126
222/1
2015/0369531 A1* 12/2015 Hall ..... B67D 7/82
222/1

* cited by examiner

REFRIGERATOR

CROSS-REFERENCE TO RELATED APPLICATIONS

The present application claims priority under 35 U.S.C. 119 and 35 U.S.C. 365 to Korean Patent Application No. 10-2014-0047747 (filed on Apr. 21, 2014), which is hereby incorporated by reference in its entirety.

FIELD

The present disclosure relates to a refrigerator, and more particularly, to a refrigerator that is capable of easily dispensing water through a dispenser.

BACKGROUND

In general, refrigerators are home appliances for storing foods at a low temperature in a storage space that is covered by a door. For this, refrigerators cool the inside of the storage space by using cool air generated by being heat-exchanged with a refrigerant circulated into a refrigeration cycle to store foods in an optimum state.

In recent years, refrigerators having various convenience equipment have been brought to the market. A dispenser for dispensing water or ice from the outside in a state where a refrigerator is closed is one representative example of such convenience equipment.

In general, such dispenser is provided in a front surface of a refrigerator door to dispense water or ice by manipulating a lever. For this, the dispenser can include a water nozzle for dispensing water. The lever can be disposed under the water nozzle. Thus, the lever can be manipulated to dispense water.

SUMMARY

According to one aspect, a refrigerator includes a main body, a storage space defined within the main body, a door configured to open and close at least a portion of the storage space, a dispenser provided in the door and defining a space in which water is dispensed, a water nozzle extending downward into the space, where the water nozzle is movably mounted at the dispenser and configured to dispense water, a manipulation detection device provided at the dispenser, the manipulation detection device being configured to detect movement of the water nozzle, and a control unit configured to open and close a water supply valve connected to the water nozzle according to a detection signal generated by the manipulation detection device.

Implementations according to this aspect may include one or more of the following features. For example, the water nozzle may be connected to a flexible water supply hose that is configured to supply water. An elevation guide may be configured to guide a vertical movement of the water nozzle is disposed on the dispenser. The water nozzle may include a hinge that protrudes from the water nozzle, the hinge serving as a rotation shaft of the water nozzle, and the hinge may be configured to be guided by the elevation guide. The water nozzle may include a manipulation handle configured to manipulate a vertical position of the water nozzle. The manipulation detection device may be configured to be activated based on the water nozzle being in a descended position. The water nozzle may extend downward by passing through a top surface of the dispenser. The refrigerator may further include a manipulation lever that is configured to cause dispensing of water or ice and that is disposed at a rear portion of the space defined within the dispenser. The manipulation level may be configured to generate a manipulation signal based on being manipulated, and the control unit may be configured to, based on the manipulation detection device being turned on, ignore the manipulation signal of the manipulation lever. The water nozzle may be disposed at a front side of the manipulation lever. The water nozzle may be configured to maintain contact with the manipulation detection device and to return to its initial position by a restoring force of the manipulation detection device. The water nozzle may include a contact member formed of rubber or urethane and configured to make contact with a container for receiving water.

Further according to this aspect, the refrigerator may further include a display unit that is configured to output an activated state of the manipulation detection device and that is disposed on the door. The refrigerator may further include a chute cover that covers at least a portion of the water nozzle and that is disposed at the dispenser. The refrigerator may further include a stopper that is configured to restrict movement of the water nozzle and that is disposed at the dispenser. The refrigerator may further include a manipulation part that is configured to selectively manipulate activation of the manipulation detection device and that is disposed at the dispenser. The dispenser may include an elastic member that is in contact with the water nozzle and configured to return the water nozzle to its initial position by providing an elastic restoring force generated based on a movement of the water nozzle. The refrigerator may further include a display unit that is configured to display a manipulation method of the water nozzle and that is disposed at the dispenser. The water nozzle may be disposed at a front side of an ice chute through which ice is dispensed. An outlet of the water nozzle may be disposed under an outlet of an ice chute. The refrigerator may further include a manipulation lever that is disposed at the dispenser and that is configured to manipulate the opening and closing of the water supply valve based on the manipulation detection device being turned off. The water nozzle may be rotatably mounted at the dispenser, and the water nozzle may be configured to rotate to turn the manipulation detection device on or off. The water nozzle may include a tube-shaped nozzle including a portion that is exposed to the space within the dispenser, the tube-shaped nozzle being configured to be manipulated via the exposed portion, and a flexible tube-shaped water supply hose connected to an upper end of a manipulation part, the water supply hose being configured to be bent according to a movement of the manipulation part. The refrigerator may further include a bending guide that is configured to guide bending of the water supply hose and that is disposed at the dispenser. The water nozzle may be movably mounted at the dispenser and configured to move in a forward-backward direction, the water nozzle further including a forward-backward movement guide that may extend in a forward-backward direction, that may be disposed at the dispenser, and that may be configured to guide the forward-backward movement of the water nozzle.

The details of one or more implementations are set forth in the accompanying drawings and the description below. Other features will be apparent from the description and drawings, and from the claims.

DETAILED DESCRIPTION

Reference will now be made in detail to the implementations of the present disclosure, examples of which are illustrated in the accompanying drawings. The technical scope of the implementations will fall within the scope of this disclosure, and addition, deletion, and modification of components or parts are possible within the scope of the implementations.

For convenience of description and understanding of a refrigerator according to implementations, although a refrigerator in which a refrigerating compartment is disposed above a freezing compartment, and a pair of doors is disposed on left and right sides of the refrigerating compartment is described as an example, the refrigerator may be applied all types of refrigerators including a dispenser in a refrigerator door.

Figure 1:
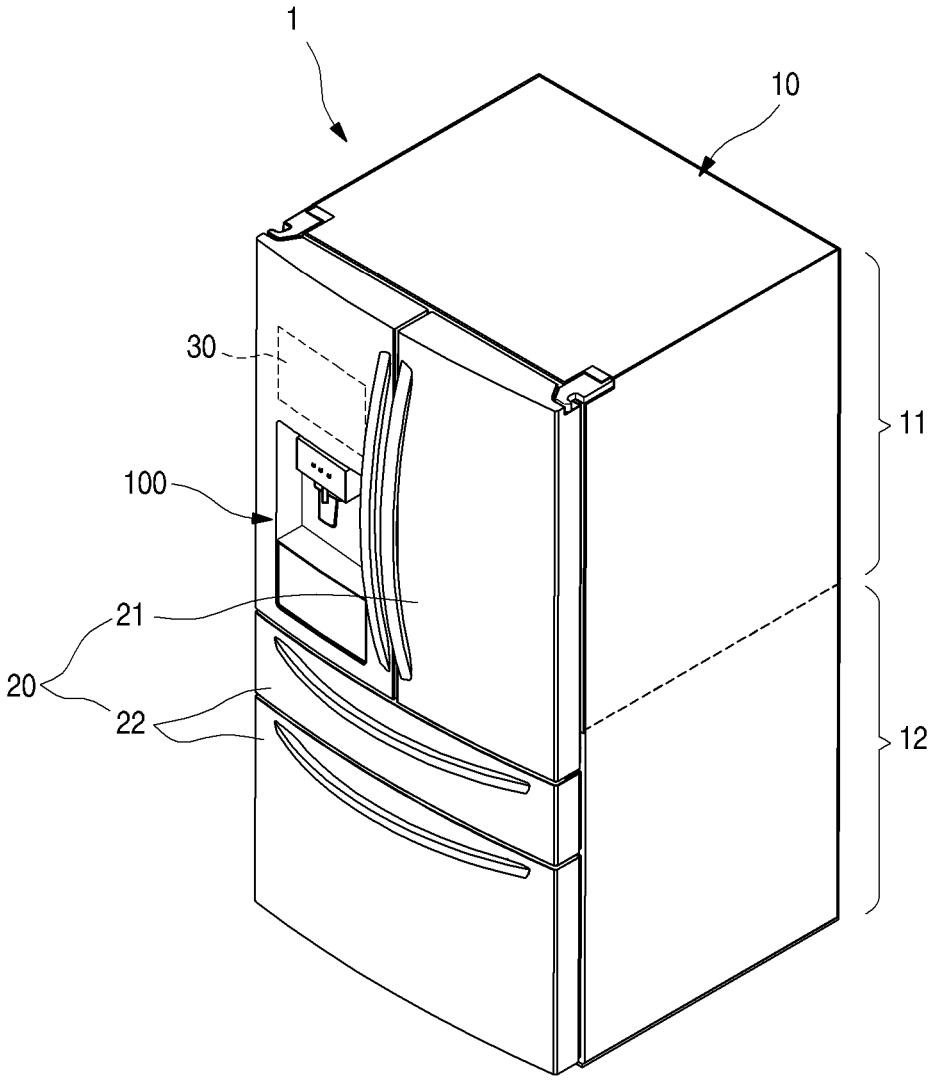
FIG. 1 is a perspective view showing an example refrigerator according to a first implementation.

FIG. 1 shows a refrigerator according to a first implementation.

Referring to FIG. 1, a refrigerator 1 according to a first implementation includes a main body 10 defining a storage space and a door 20 disposed on the main body 10 to open/close the storage space. As shown, the whole outer appearance of the refrigerator 1 may be defined by the main body 10 and the door 20.

The storage space within the main body 10 may be vertically partitioned to define a refrigerating compartment 11 at an upper side and a freezing compartment 12 at a lower side. As shown, the lower storage space may be partitioned into a plurality of compartments so that at least one of the plurality of compartments is used as the refrigerating compartment or other storage space. In some cases, the lower storage space may be provided as one space and also opened or closed by a plurality of doors.

The door 20 may include a refrigerating compartment door 21 for opening/closing the refrigerating compartment 11 and a freezing compartment door 22 for opening/closing the freezing compartment 12.

The refrigerating compartment door 21 may be provided in a pair on both left and right sides. Also, the refrigerating compartment door 21 may be rotatably mounted on the main body 10 to open or close the whole or a portion of the refrigerating compartment 11.

Also, the freezing compartment door 22 may be slidably inserted into or withdrawn from the freezing compartment 12 in a drawer type. A basket may be mounted on a back surface of the freezing compartment door 22. Here, the basket may also be inserted or withdrawn together with the freezing compartment door 22. The freezing compartment door 22 may be provided in plurality. The plurality of freezing compartment doors 22 may be vertically disposed to form independent storage spaces.

A dispenser 100 may be disposed in the refrigerator compartment door 21. The dispenser 100 is configured to dispense water supplied from a water supply source or ice supplied from an ice making assembly 30 in a state where the refrigerating compartment door 21 is closed. Here, the dispenser 100 may dispense the water or ice to the outside by user's manipulation.

Although the dispenser 100 is disposed on one of the pair of refrigerating compartment doors 21 (hereinafter, referred to as a "door"), the dispenser 100 may be mounted in various positions according to the particular structure and configuration of the refrigerator.

Also, the water supply source for supplying water into the dispenser 100 may be a water pipe disposed outside the refrigerator 1 and connected to the refrigerator 1 or a water tank provided in the refrigerator 1. As shown, a water purifying filter and a water supply valve 50 may be further provided in a water supply passage connected to the dispenser 100 to supply purified water into the dispenser 100.

Also, the ice making assembly 30 may be disposed on the back surface of the door 21 in which the dispenser 100 is disposed or an inner side of the main body 10. The ice making assembly 30 has a structure in which ice may be made by using water supplied from the water supply source, and the made ice can be stored and dispensed to the outside through the dispenser 100 when the dispenser 100 is manipulated.

The stored ice may be dispensed in an ice cube state. Also, a blade for crushing the stored ice while the stored ice is transferred by the user's manipulation to dispense crushed ice and a motor (see reference numeral 31 of FIG. 4) for rotating the blade may be provided in the ice making assembly 30.

Figure 2:
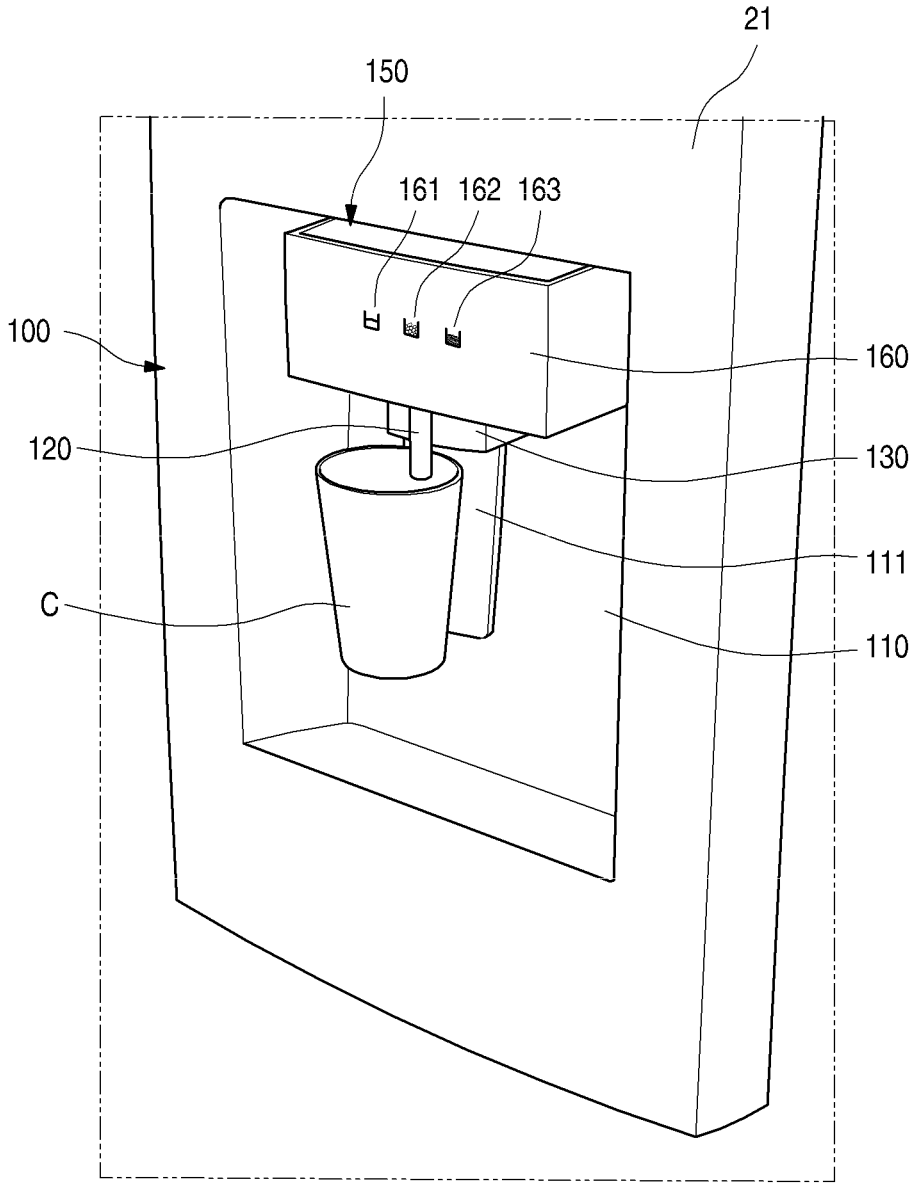
FIG. 2 is a perspective view showing an example dispenser according to the first implementation.
Figure 3:
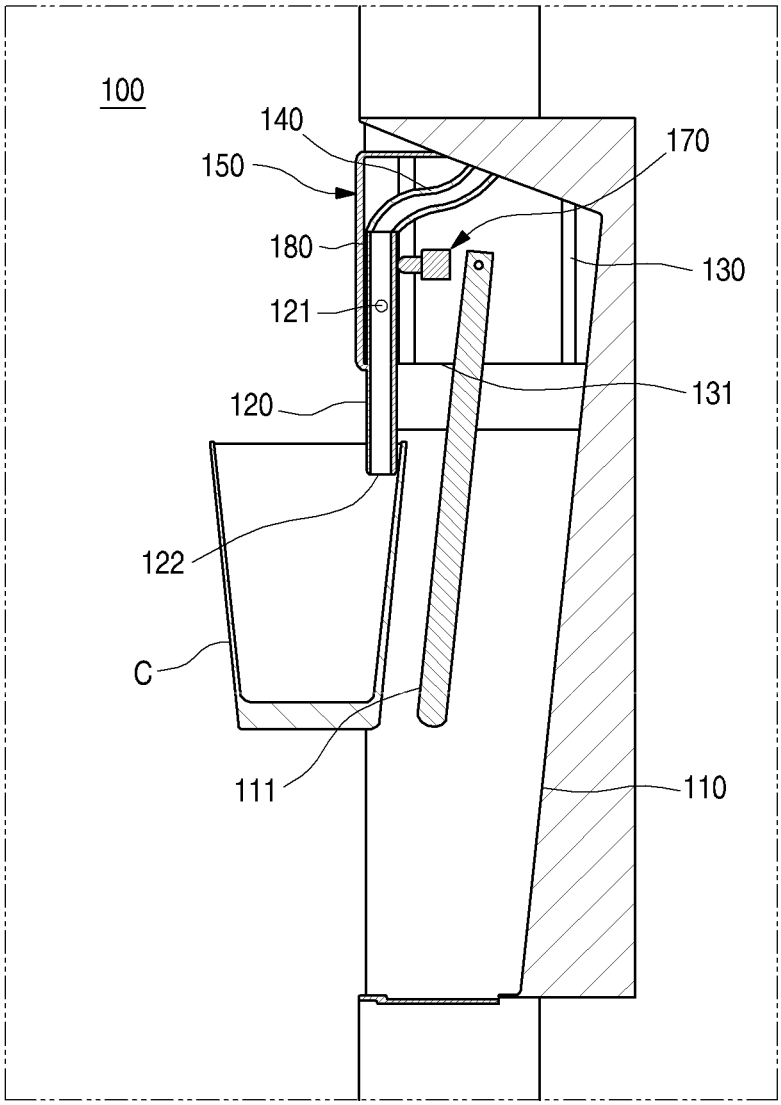
FIG. 3 is a cross-sectional view of the dispenser.
Figure 4:
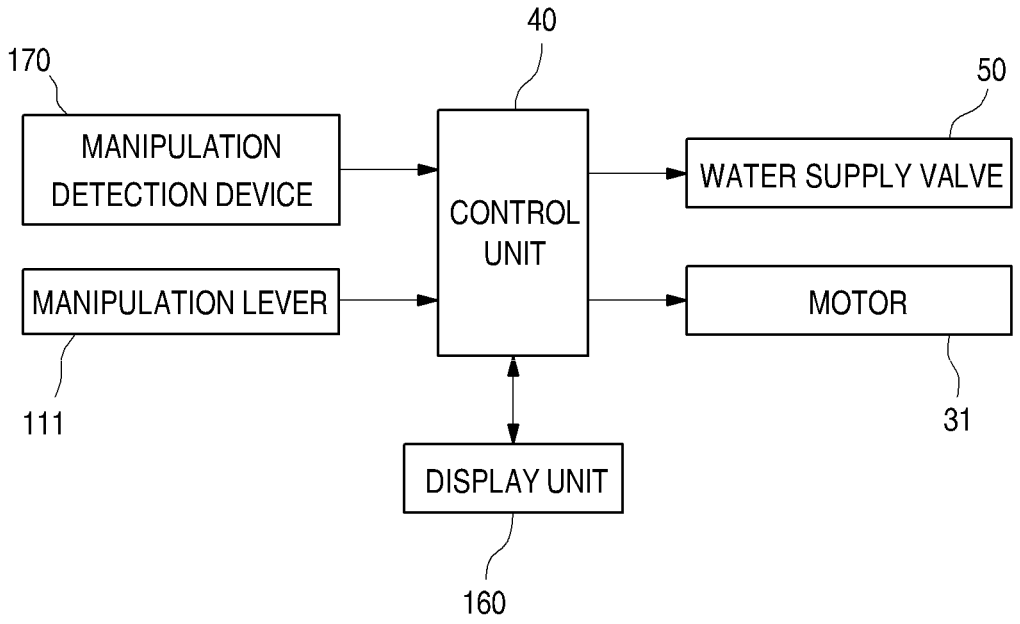
FIG. 4 is a block diagram illustrating an example flow of a manipulation signal of the dispenser.

Referring to FIGS. 2 to 4, the dispenser 100 may include a dispenser case 110 providing a space that is recessed from a front surface of the door 21, water and ice nozzles 120 and 130 for dispensing water and ice, a cover 150 for covering at least a portion of a front side of the water and ice nozzles 120 and 130, a manipulation lever 111 manipulated for dispensing of ice, and a display unit 160 for displaying an operation state of the refrigerator 1.

In more detail, the dispenser case 110 is disposed on the front surface of the door 21 and provides a space that is recessed inward to accommodate a container such as a cup when the water or ice is dispensed.

The dispenser case 110 can have a flat bottom surface on which the container may be placed. The manipulation lever 111 may be manipulatably mounted on a rear surface of the dispenser case 110.

Also, the water nozzle 120 and the ice nozzle 130 extend downward from a top surface of the dispenser case 110.

Outlets 122 and 131 of the water and ice nozzles 120 and 130 may have openings that face downward. Thus, water or ice may be dispensed through the dispenser 100.

The water nozzle 120 is configured to dispense the purified water and can have a tube shape. Also, the water nozzle 120 may be connected to a water supply hose 140 connected to the water supply source to supply water. Also, the user may directly manipulate the water nozzle 120 to dispense water through the water nozzle 120.

Also, the ice nozzle 130 is disposed at a rear side of the water nozzle 120 to form a passage through which ice transferred from the ice making assembly 30 is dispensed. The ice nozzle 130 may be connected to an ice chute defined in the door 21 to dispense ice through the dispenser 100.

Also, the manipulation lever 111 may be disposed under the ice nozzle 130. The manipulation lever 111 may be disposed on a rear wall of the dispenser case 110 so that the user is capable of pushing or rotating the manipulation lever 111. Thus, as the user manipulates the manipulation lever 111, ice may be dispensed through the ice nozzle 130.

The cover 150 surrounding the water nozzle 120 and the ice nozzle 130 may be disposed on an upper portion of the dispenser case 110. The cover 150 is disposed on a front side of the water nozzle 120 and the ice nozzle 130 to cover the water nozzle 120 and the ice nozzle 130. As shown, a lower end of each of the water nozzle 120 and the ice nozzle 130 may be exposed so that the user can distinguish between the water nozzle 120 and the ice nozzle 130, thereby allowing the user to easily place a container C at the desired position.

A display unit 160 may be disposed on a front surface of the cover 150. The display unit 160 is configured to display the selected state and operation state of the dispenser 100 that is manipulated by a manipulation member. Since the display unit 160 is disposed above the same extension line as the water nozzle 120 and the manipulation lever 111, when water or ice is dispensed, the user may simultaneously recognize a dispensing process of the water or ice and a state of the display unit 160.

The display unit 160 may be displayed in an icon shape. Alternatively, the display unit 160 may be turned on/off on an area that is set by a light emitting member to display the state.

For example, a water selection mode 161, an ice cube selection mode 162, and a crushed ice selection mode 163 may be provided on the display unit 160. The corresponding mode may be turned on by the user's manipulation to display the dispensing state.

Also, a state in which the water nozzle 120 directly moves to dispense water may be displayed on the display unit 160 so that the user intuits the manipulation method of the water nozzle 120.

The display unit 160 may be disposed on a side of the dispenser 100 other than the cover 150 or, in some cases, may be disposed on another side of the dispenser 100 in addition to being disposed on the cover 150 to display the overall operation state of the refrigerator 1. Also, the display unit 160 may be realized by using various forms in addition to the turn-on/off manner described above. For example, the display unit 160 may be provided as a speaker for informing the selected state by using voice.

In some cases, the display unit 160 may be configured to select an operation as well as display the operation state. For example, when the user receives water, the user may not manipulate the water nozzle 120, but instead manipulate the manipulation lever 111 after the user directly inputs the water selection mode 161 on the display unit 160 to dispense water. Also, activation of a manipulation detection device 170 may be selectively turned on/off through the manipulation of the display unit 160. Thus, in a case where it is unnecessary to supply water through the direct manipulation for the movement of the water nozzle 120, the manipulation detection device 170 may be turned off.

In some cases, when ice is dispensed, the manipulation lever 111 may be manipulated after one of the ice cube selection mode 162 and the crushed ice selection mode on the display unit 160 is selected to dispense ice corresponding to the selected mode. The above-described dispensing manner may be performed by manipulating the other manipulation part provided on one side of the dispenser 100 without being limited to the display unit 160 disposed on the cover 150.

In more detail, the water nozzle 120 may have a tube shape having a predetermined diameter. Also, the water nozzle 120 may be formed of a hard material that is not deformed, such as stainless steel or aluminum.

As shown, the water nozzle 120 extends downward from the cover 150. Here, the water nozzle 120 may extend to a length that is sufficient to enable user identification and manipulation. In some cases, the water nozzle 120 may be extended to an upper side or an upper portion of the manipulation lever 111 so as to not interfere with the manipulation of the manipulation lever 111.

An upper end of the water nozzle 120 is disposed in an inner region of the cover 150 and is rotatably mounted inside the cover 150. A rotation shaft 121 of the water nozzle 120 is disposed in the inner region of the cover 150, i.e., at a rear side of the cover 150 when viewed in FIG. 5. The water nozzle 120 extends upward past the rotation shaft 121.

The water nozzle 120 is disposed adjacent to a front surface of the cover 150 to rotate in a single direction, in other words by being pulled in a forward direction. That is, when the water nozzle 120 exposed to the dispenser 100 is pushed backward, the upper end of the water nozzle 120 may interfere with the front surface of the cover 150 and therefore be prevented from rotating. On the other hand, when the water nozzle 120 exposed to the dispenser 100 is pulled forward, the water nozzle 120 can rotate in a clockwise direction (see FIG. 5) about the rotation shaft 121.

In some cases, the structure of the rotation shaft 121 may be limited to allow the water nozzle 120 to rotate in only one direction. A stopper may be disposed on one side of the water nozzle 120 or the cover so that the water nozzle 120 rotates in only one direction.

The manipulation detection device 170 may be disposed at a rear side of the water nozzle 120. The manipulation detection device 170 may detect the rotation manipulation of the water nozzle 120. The manipulation detection device 170 is disposed above the rotation shaft 121 to contact an upper portion of the water nozzle 120 when the water nozzle 120 rotates in the clockwise direction.

The manipulation detection device 170 may be provided as a general contact switch or pressure sensor, a proximity sensor, and the like. The manipulation detection device 170 may detect rotation of the water nozzle 120. Also, the manipulation detection device 170 is connected to a control unit 40 to determine an opening/closing of the water supply valve 50.

Thus, when the water nozzle 120 is pulled forward, the upper portion of the water nozzle 120 rotates in the clockwise direction to push the manipulation detection device 170. Thus, the manipulation detection device 170 may detect the movement of the water nozzle 120 to transmit a signal to the control unit 40. Also, the control unit 40 receiving the manipulation signal from the manipulation detection device 170 may allow the water valve 50 to be opened, thereby supplying water.

In some cases, the manipulation detection device 170 may be provided as a switch type that can be pushed. The manipulation detection device 170 may be pushed by the water nozzle 120 to receive the manipulation signal. Also, when an external force applied to the water nozzle 120 is removed, the water nozzle 120 may return to its original position by an elastic restoring force of the manipulation detection device 170.

In some cases, a separate elastic member 180 may be further disposed on one side of the water nozzle 120. That is, the water nozzle 120 may return to its original position by the separate elastic member 180 after being manipulated. The elastic member 180 may be a torsion spring disposed on the rotation shaft 121 or a coil spring connecting the cover 150 to the upper end of the water nozzle 120.

A water supply hose 140 may be connected to the upper end of the water nozzle 120. The water supply hose 140 may connect the water supply source to the water nozzle 120. Also, the water supply hose 140 may be formed of a flexible material such as rubber or silicon and have a tube shape. When the water nozzle 120 rotates, the connection between the water supply source and the water nozzle 120 may be stably maintained by the water supply hose 140 to smoothly supply water.

Hereinafter, an example operation of the dispenser including the above-described structure according to the first implementation will be described.

Figure 5:
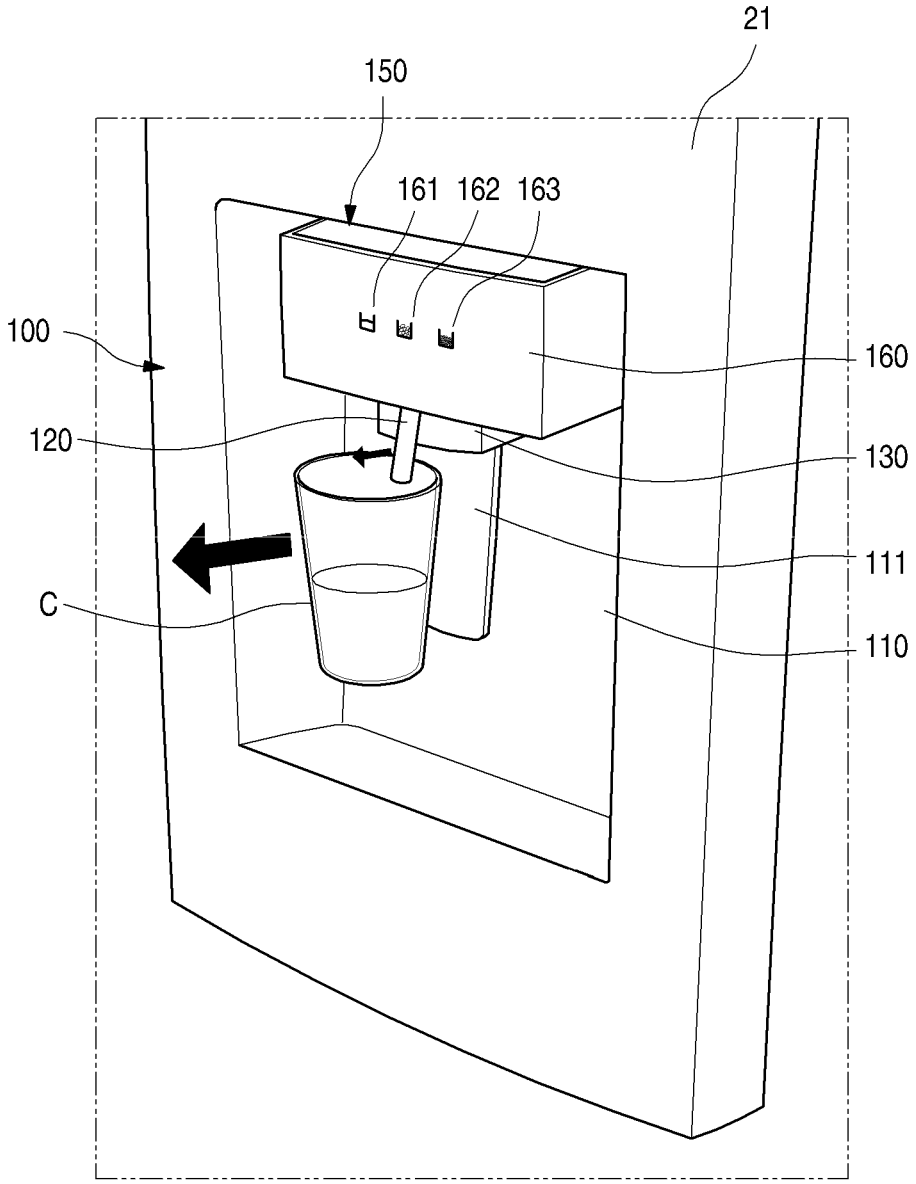
FIG. 5 is a perspective view illustrating an example manipulation of a water nozzle according to the first implementation.
Figure 6:
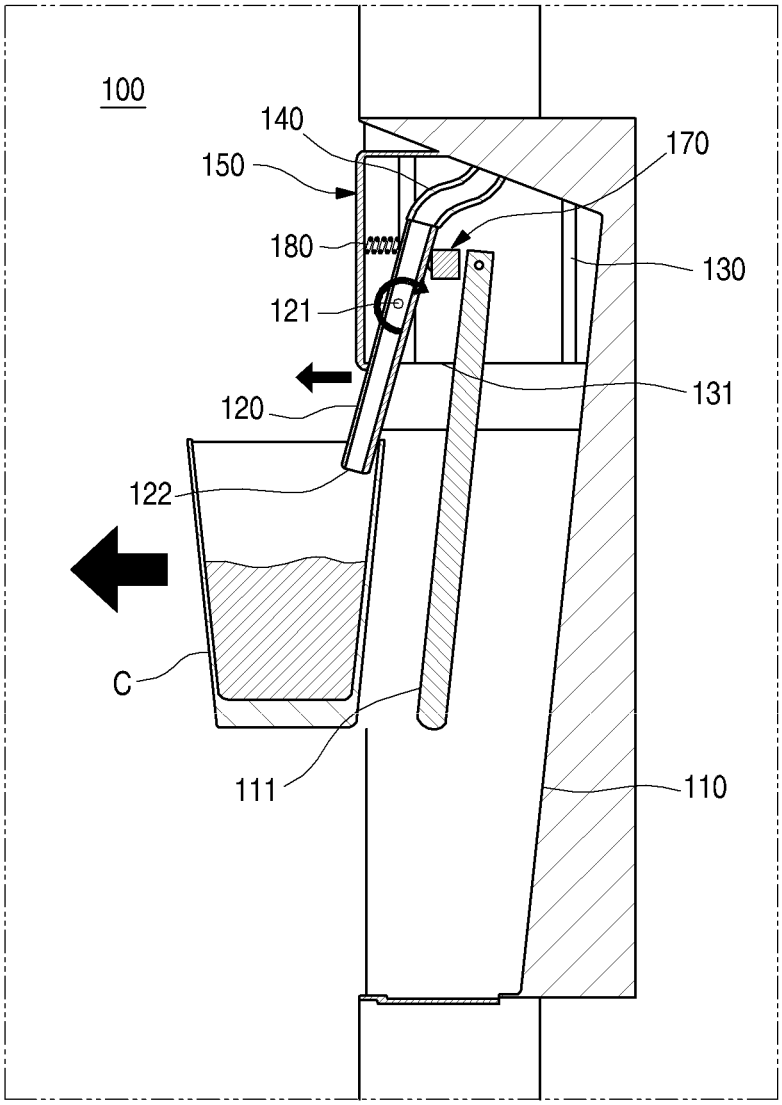
FIG. 6 is a cross-sectional view illustrating an example manipulation of the water nozzle.

Referring to FIGS. 5 and 6, before the user manipulates the water nozzle 120 of the dispenser 100, the water nozzle 120 may be in a vertical state as illustrated in FIGS. 2 and 3. In this state, a separate operation signal is not transmitted to the control unit 40, and thus, the water supply valve 50 is maintained in a closed state.

In the above-described state, the user may move a container C such as a cup downward from an upper side to allow the water nozzle 120 to be disposed inside the container C. Thus, the inner surface of the container C and a lower portion of the water nozzle 120 can contact each other.

In this state, when the user pulls the water nozzle 120 forward, the water nozzle 120 rotates about the rotation shaft 121. Then, the upper portion of the water nozzle 120 pushes the manipulation detection device 170 that is disposed at a rear side of the water nozzle 120 to transmit a manipulation signal.

When the manipulation signal is detected by the control unit 40, the control unit 40 may control the water supply valve 50 to open the water supply valve 50. Thus, water may be supplied into the water nozzle 120 through the control of the water supply valve 50.

That is, as illustrated in FIGS. 5 and 6, when the water nozzle 120 exposed to the dispenser is pulled in a state where the water nozzle is accommodated in the container C, water is supplied through the water nozzle 120 to dispense the water into the container C.

Also, in the state where the water has been completely dispensed through the water nozzle 120, the user can separate the container C from the water nozzle 120, at which point the water nozzle 120 may return to the state it was before being manipulated as illustrated in FIGS. 2 and 3 by the restoring force provided from the manipulation detection device 170. In some cases, the water nozzle 120 may be returned to its original position by the restoring force of the separate elastic member 180.

The above-described manipulation may be performed by the user without using the other hand to manipulate the other manipulation member. Instead, the above-described manipulation can be performed directly using one hand by, for example, pulling the water nozzle 120. Thus, the above-described manipulation may be intuitively and immediately performed.

Also, when the user intends to dispense ice, the manipulation lever 111 disposed under the ice nozzle 130 may be manipulated to dispense ice, like the general manipulation of the dispenser 100.

In the state where the manipulation signal of the water nozzle is inputted, the operation of the manipulation lever 111 may be forcibly stopped. Thus, even though the manipulation lever 111 is unintentionally manipulated during the manipulation of the water nozzle 120, ice may not be dispensed.

Also, in the state where the manipulation signal is being inputted, the signal of the manipulation detection device 170 may be ignored to prevent water from being dispensed even though the water nozzle 120 is unintentionally manipulated during the dispensing of the ice.

The refrigerator according to the current implementation may be applied to various implementations in addition to the foregoing implementation. Hereinafter, a refrigerator according to a second implementation will be described with reference to the accompanying drawings.

The second implementation may have a feature in which a water nozzle is vertically elevated. Thus, when the water nozzle is not used, the water nozzle may move upward and then be inactivated, and when the water nozzle is used, the water nozzle may move downward and then be activated to prevent the water nozzle from being malfunctioned.

The second implementation is equal to the foregoing implementation except for an elevation structure of the water nozzle. Thus, the same part will be designated by the same reference numeral, and detailed descriptions thereof will be omitted.

Referring to FIGS. 7 to 10, a dispenser 200 according to the second implementation has a space that is recessed by a dispenser case 210 provided in a front surface of a door 21. Also, a water nozzle 220 and an ice nozzle 230 which extend downward from an upper side are provided in the dispenser 200. Also, a manipulation lever 211 manipulated to dispense ice from the ice nozzle 230 is disposed under the ice nozzle 230.

Also, in the dispenser 200, at least portions of upper portions of the water nozzle 220 and the ice nozzle 230 may be covered by a cover 250 on which the display unit 260 is disposed. The water nozzle 220 may be vertically elevatable. Thus, when the water nozzle 220 is not used, the water nozzle 220 can move upward to expose only an end thereof. On the other hand, when the water nozzle is used, the water nozzle 220 can move downward to easily rotate.

In detail, a manipulation handle 222 protrudes from a lower portion of a front surface of the water nozzle 220. Thus, the user may vertically move the water nozzle 220 by using the manipulation handle 222.

Also, a rotation shaft 221 protruding in both left and right directions is disposed on an upper portion of the water nozzle 220. The rotation shaft 221 may serve as a rotation center of the water nozzle 220 when the water nozzle 220 is manipulated. The rotation shaft 221 may protrude in both left and right directions and be inserted into a guide groove 291 of an elevation guide 290 disposed at a rear side of the cover 250.

The elevation guide 290 guides the vertical movement of the water nozzle 220. The elevation guide can extend in length in a vertical direction to provide a path through which the rotation shaft 221 moves in the state where the rotation shaft 221 is inserted into the guide groove 291.

When the rotation shaft 221 is disposed on an upper end of the guide groove 291, the water nozzle 220 may be in a state in which the water nozzle 220 is disposed at the uppermost position. Thus, the rotation of the water nozzle 220 may be impossible. Also, when the rotation shaft 221 is disposed on a lower end of the guide groove 291, the water nozzle may be in a state in which the water nozzle 220 is disposed at the lowermost position. Thus, the rotation of the water nozzle 220 may be possible.

A detection member 292 may be further disposed on the upper end of the guide groove 291. When the water nozzle 220 completely moves upward, the detection member 292 may contact the rotation shaft 221. Also, the detection member 292 may contact the rotation shaft 221 to transmit a signal to a control unit 40 so that a signal of the manipulation detection device 270 is ignored.

That is, in the state where the water nozzle 220 moves upward, even though the manipulation detection device 270 may generate a manipulation signal when, for example, the water nozzle 220 is mistakenly manipulated due to user error, the control unit 40 may prevent the water supply valve 50 from being opened.

The manipulation detection device 270 may be disposed at a rear side of the water nozzle 220. That is, the manipulation detection device 270 may be disposed at a position at which the manipulation detection device 270 contacts the upper portion of the water nozzle 220 when the water nozzle 220 rotates in the state where the water nozzle 220 moves downward.

Here, a button part 271 of the manipulation detection device 270 moves backward by the manipulation of the water nozzle 220 to press a spring 272. Then, when the container C is separated from the water nozzle 220, the water nozzle 220 returns to its original position by a restoring force of the spring 272.

Hereinafter, an operation of the dispenser 200 according to the second implementation will be described.

Figure 7:
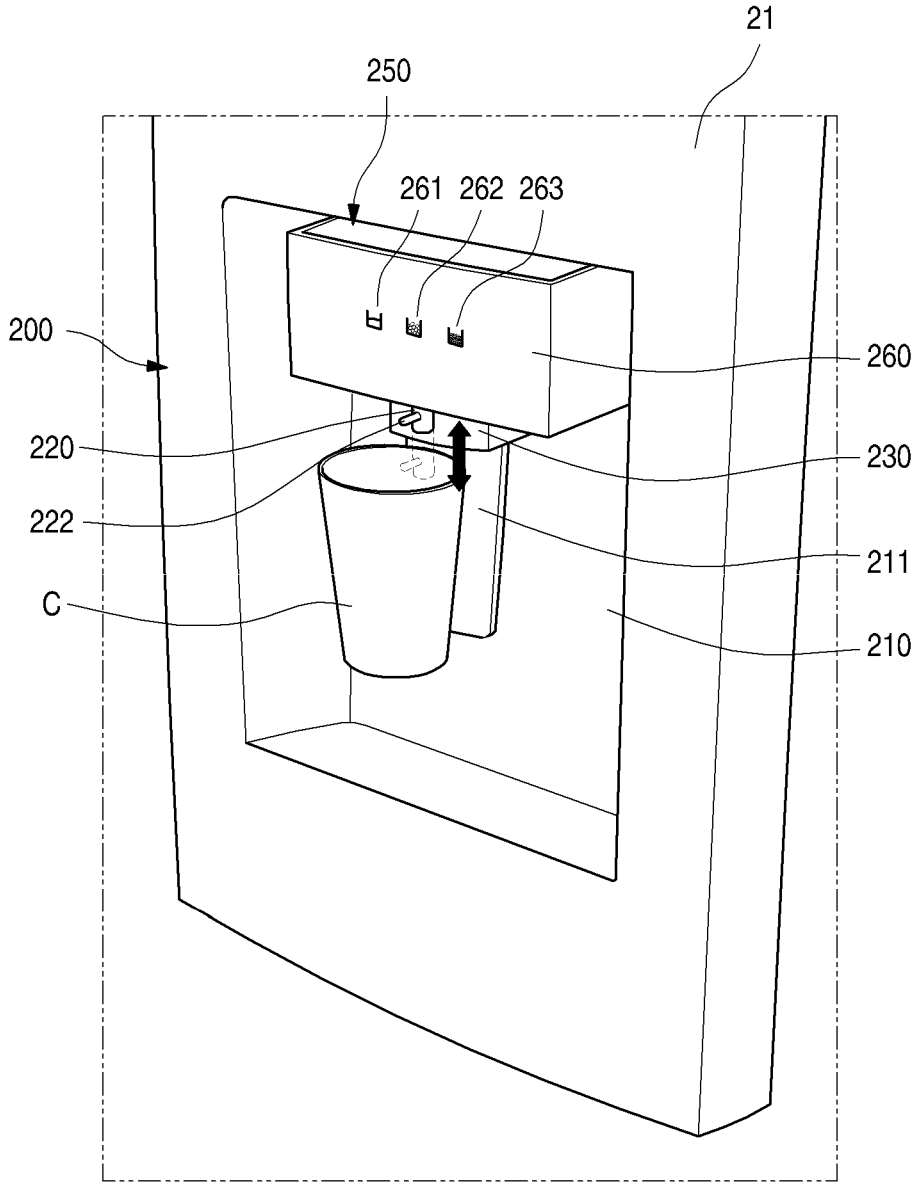
FIG. 7 is a perspective view showing an example dispenser according to a second implementation.
Figure 8:
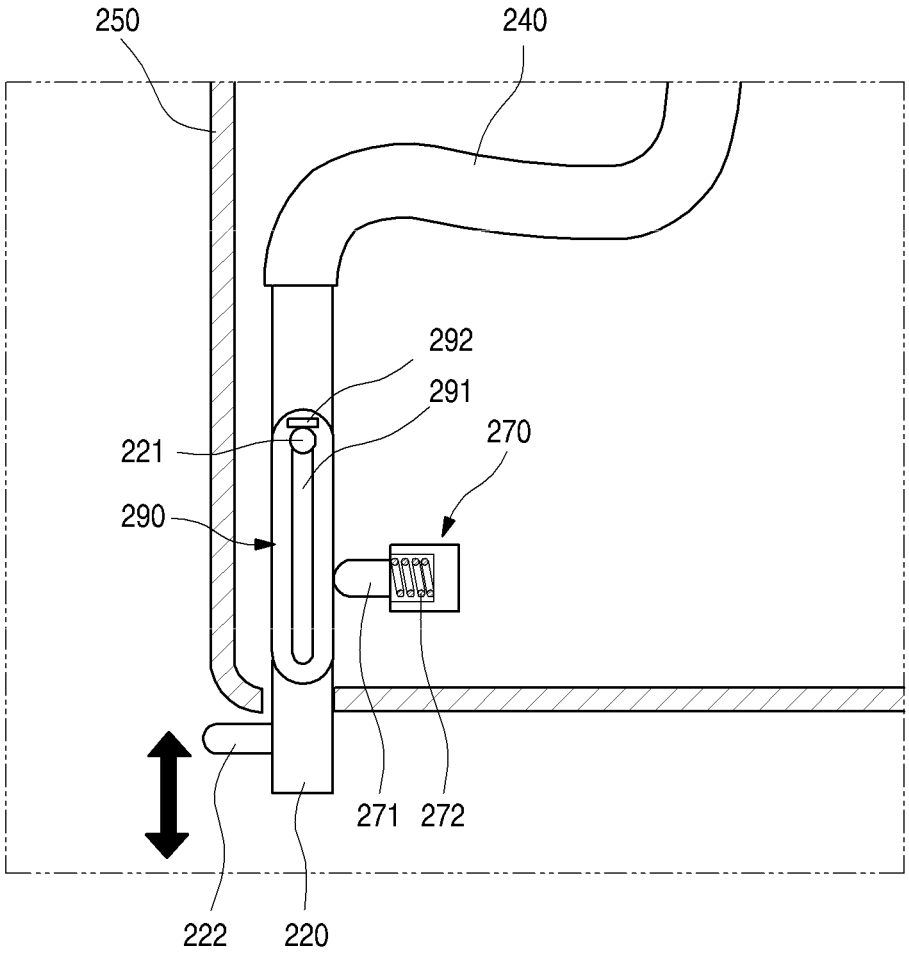
FIG. 8 is a cross-sectional view showing an example structure of the dispenser.

In a state before water is dispensed through the dispenser 200, as illustrated in FIGS. 7 and 8, the water nozzle 220 may be in a state in which the water nozzle 220 moves upward, and the manipulation handle 222 may be in a state in which a front part of the manipulation handle 222 is exposed. In this state, the manipulation lever 211 may be completely exposed so that ice can be easily dispensed by manipulating the manipulation lever 211.

Figure 9:
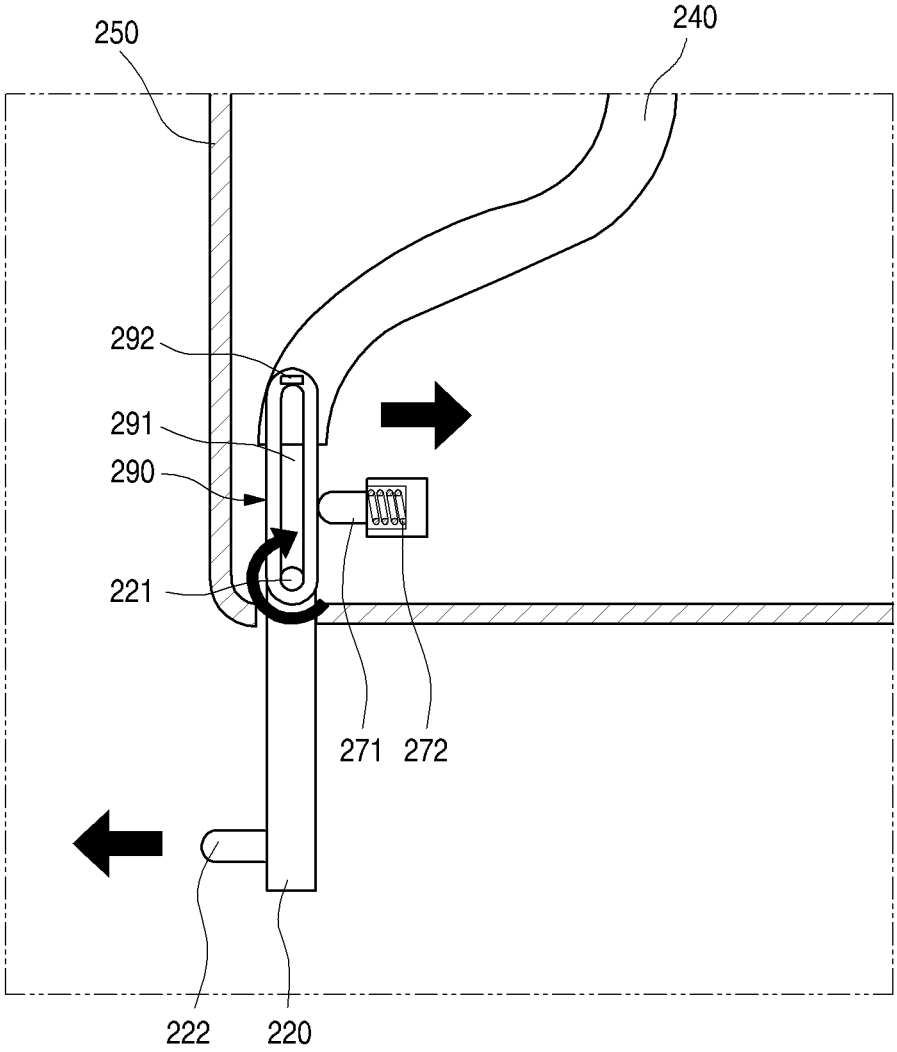
FIG. 9 is a cross-sectional view illustrating an example state in which a water nozzle is withdrawn according to the second implementation.
Figure 10:
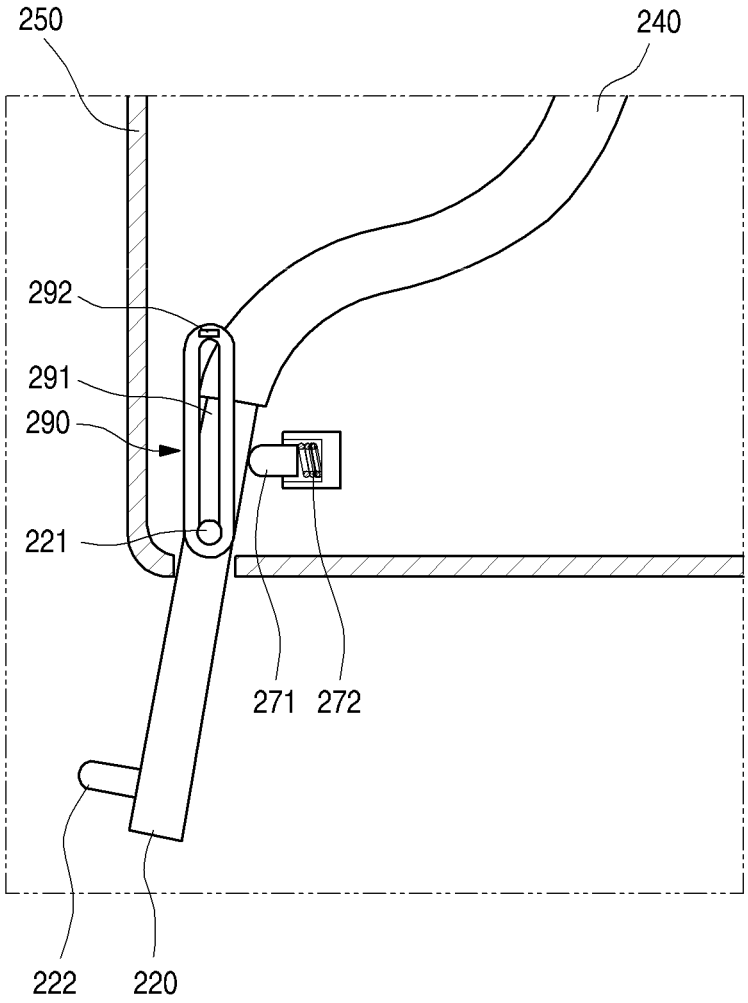
FIG. 10 is a cross-sectional view illustrating an example state in which the water nozzle is manipulated.

To allow the user to manipulate the water nozzle 220, thereby dispensing water, the user may grasp the manipulation handle 222 to move the water nozzle 220 downward. FIG. 9 illustrates this state. Here, the manipulation detection device 270 may be activated to detect the rotation of the water nozzle 220 when the water nozzle 220 rotates.

In the state shown in FIG. 9, the user may pull the water nozzle 220 by using the container C in the state where the water nozzle 220 is disposed within the container C. The water nozzle 220 may rotate in a clockwise direction with respect to the rotation shaft by the above-described manipulation to become to the state of FIG. 10. Thus, the upper portion of the water nozzle 220 may push the manipulation detection device 270 to transmit a manipulation signal to the control unit 40.

When the control unit 40 receives the operation signal of the manipulation detection device 270, a water supply valve 50 may be opened. Thus, water may pass through a water supply hose 240 and then be supplied into the container C through the water nozzle 220.

When the manipulation of the water nozzle 220 is completed, when the container C is separated from the water nozzle 220, the water nozzle 220 may rotate in a counterclockwise direction by the spring 272 of the manipulation detection device 270 to return to its original position.

In this state, if water is not supplied, the user may move the water nozzle 220 upward by using the manipulation handle 222. Thus, the rotation shaft 221 may contact the detection member 292, and the manipulation detection device 270 may be inactivated. As a result, the manipulation signal may not be transmitted to the control unit 40, and arbitrary water supply may be impossible.

According to the need, if the display unit 260 or a separate manipulation part is manipulated to change the setting, water may be dispensed through the water nozzle 220. Here, when the manipulation lever 211 is manipulated, water may be dispensed.

The refrigerator according to the current implementation may be applied to various implementations in addition to the foregoing implementations. Hereinafter, a refrigerator according to a third implementation will be described with reference to the accompanying drawings.

The third implementation has a feature in which a water nozzle horizontally moves to determine supply of water.

The third implementation is equal to the foregoing implementation except for a horizontal structure of the water nozzle. Thus, the same part will be designated by the same reference numeral, and detailed descriptions thereof will be omitted.

Figure 11:
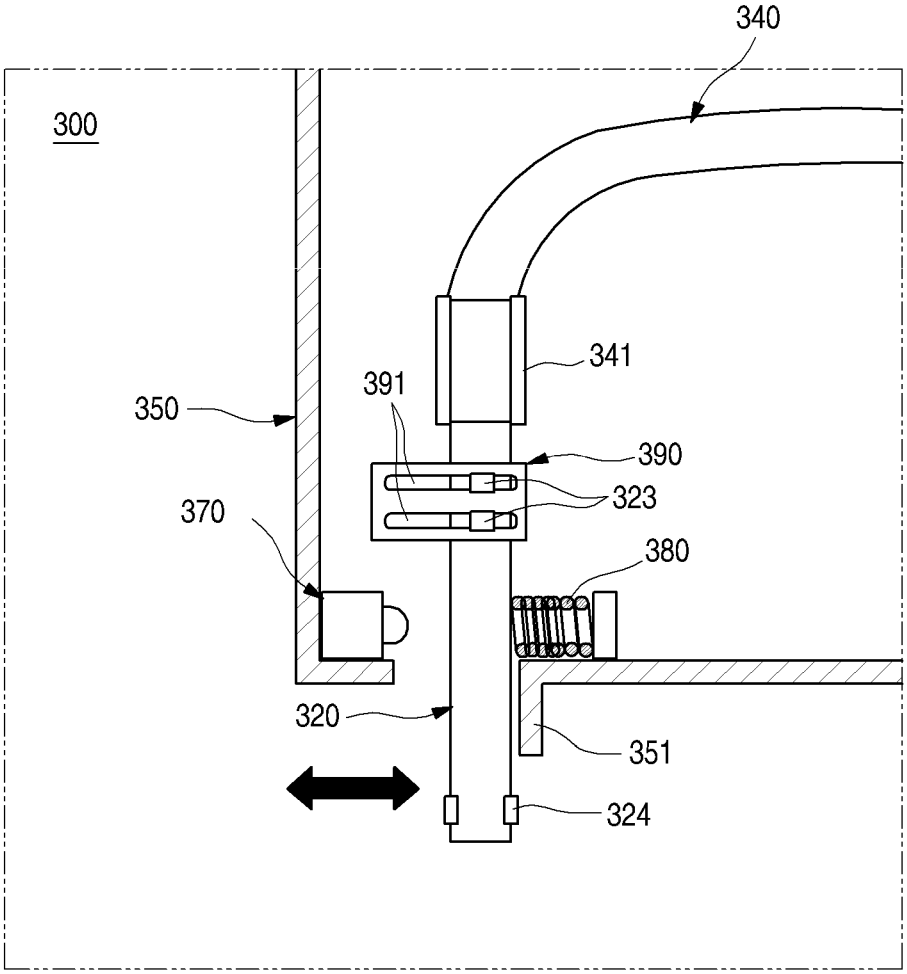
FIG. 11 is a cross-sectional view illustrating an example structure of a dispenser according to a third implementation.

FIG. 11 shows a structure of a dispenser according to the third implementation.

Referring to FIG. 11, a water nozzle 320 is provided in a dispenser 300. A portion of the water nozzle 320 may be covered by a cover 350. The water nozzle 320 passes through a top surface of a recessed space of the dispenser 300. An end of the water nozzle 320 extends downward by a predetermined length so that a user directly manipulates the water nozzle 320 to dispense water.

The water nozzle 320 may be connected to a water supply hose 340 to receive water. Also, the water nozzle 320 may horizontally move by horizontal moving manipulation of the user. For this, protrusions 323 laterally protruding from both side surfaces of an outer surface of the water nozzle 320 may be disposed to be vertically spaced apart from each other. Forward/backward movement guides 390 may be disposed on both sides of the water nozzle 320, respectively.

The forward/backward movement guides 390 are disposed on each both left and right sides with the water nozzle 320 therebetween. Also, two guide grooves 291 are defined in the forward/backward movement guides 390, and the protrusion 323 may be accommodated into each of the two guide grooves 291. Thus, when the water nozzle 320 is pushed or pulled to move the water nozzle 320, the water nozzle 320 may not rotate, but smoothly move forward or backward instead.

Also, an elastic member 380 may be disposed at a rear side of the water nozzle 320. The elastic member 380 has a coil spring shape. The elastic member 380 may have one end fixed to the water nozzle 320 and the other end fixed to one side of the water nozzle 320. When the water nozzle 320 moves forward, the elastic member 380 may be tensioned. Then, when an external force applied to the water nozzle 320 is removed, the water nozzle 320 may return to its initial position.

Also, a stopper 351 may be further disposed under the water nozzle 320. When the user pushes the water nozzle 320 backward, the stopper 351 may contact the water nozzle 320 to prevent the water nozzle 320 from moving backward. A portion of the cover 350 may be bent to form the stopper 351.

Also, a manipulation detection device 370 may be disposed at a front side of the water nozzle 320. The manipulation detection device 370 may contact the water nozzle 320 when the water nozzle 320 moves forward. The manipulation detection device 370 may transmit a manipulation signal to a control unit 40 so that a water supply valve 50 is opened to supply water.

The water nozzle 320 and a water supply hose 340 may be connected to each other by a connector 341. The connector 341 may be formed of a soft material or have a deformable structure. Thus, even though the water nozzle 320 horizontally moves, the connection state between the water supply hose 340 and the water nozzle 320 may be maintained through the connector 341. In addition, a position of the water supply hose 340 may be maintained through the connector 341.

Also, a contact member 324 may be disposed at a lower position of the water nozzle 320 that contacts a container C. The contact member 324 may be formed of rubber or urethane. Thus, the container C may not directly contact a metal material, but contact the contact member 324 to improve the manipulation feeling.

The refrigerator according to the current implementation may be applied to various implementations in addition to the foregoing implementation. Hereinafter, a refrigerator according to a fourth implementation will be described with reference to the accompanying drawings.

The fourth implementation is equal to the foregoing implementation except for a shape of the water nozzle. Thus, the same part will be designated by the same reference numeral, and detailed descriptions thereof will be omitted.

Figure 12:
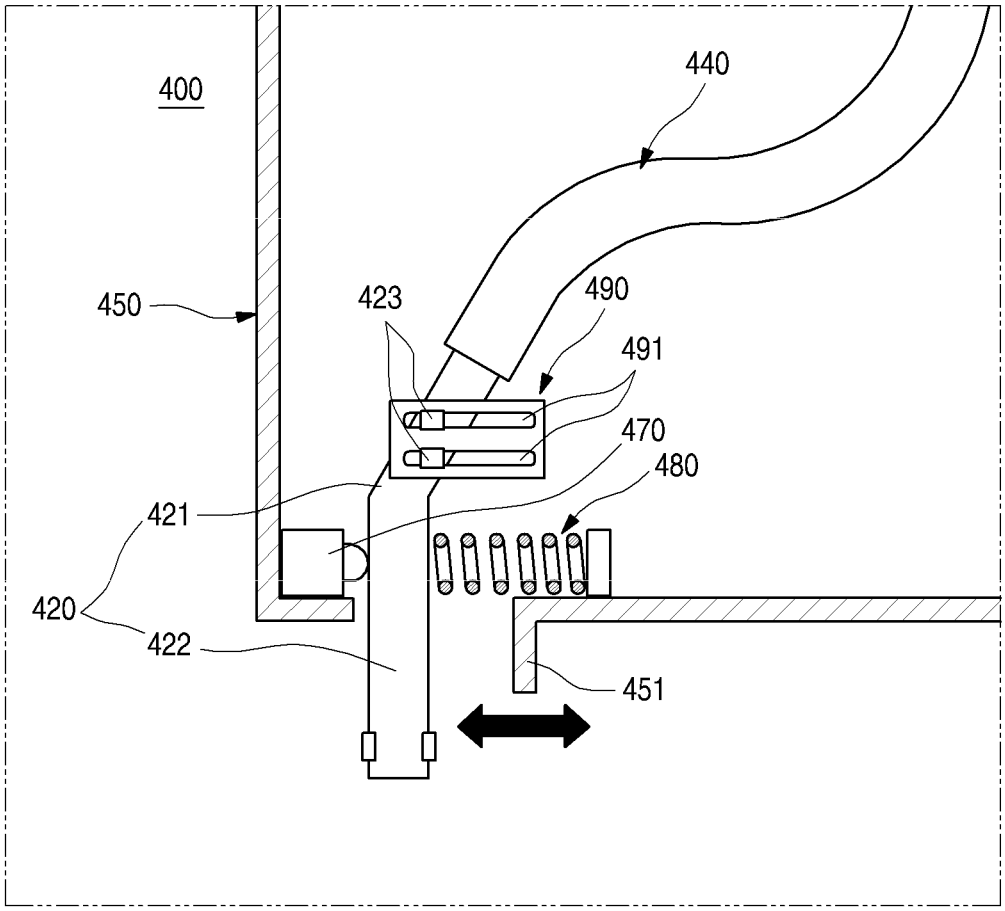
FIG. 12 is a cross-sectional view illustrating an example structure of a dispenser according to a fourth implementation.

FIG. 12 shows a structure of a dispenser according to the fourth implementation.

Referring to FIG. 12, in a dispenser 400 according to the fourth implementation, a water nozzle 420 connected to a water supply hose 440 to supply water passes through a top surface of the dispenser 400 to extend downward. A manipulation detection device 470 is disposed at a front side of the water supply hose 440, and an elastic member 480 is disposed at a rear side of the water supply hose 440.

The water nozzle 420 includes an inclination part 421 and a vertical part 422. The inclination part 421 is connected to the water supply hose 440 and inclined in a direction in which the water supply hose 440 is introduced. Thus, when the water nozzle 420 is manipulated, the inclination part 421 may prevent the water supply hose 440 from being folded or bent.

Also, the vertical part 422 extends downward from a lower end of the inclination part 421 and is exposed to the outside of a cover 450. Thus, a user may manipulate the vertical part 422 to move the water nozzle 420 forward or backward.

Also, to move the water nozzle 420 forward or backward, a protrusion 423 may be disposed on each of both left and right surfaces of the water nozzle 420. A forward/backward movement guide 490 for guiding movement of the protrusion 423 is disposed on each of both sides of the water nozzle 420.

Thus, when the user pulls the vertical part 422 of the water nozzle 420 to allow the vertical part 422 to contact the manipulation detection device 470, the control unit 40 may open the water supply valve 50 to supply water through the water nozzle 420.

The refrigerator according to the current implementation may be applied to various implementations in addition to the foregoing implementations. Hereinafter, a refrigerator according to a fifth implementation will be described with reference to the accompanying drawings.

The fifth implementation has a feature in which a bending guide for preventing a water supply hoes from being bent or folded when a water nozzle is manipulated is provided.

The fifth implementation is equal to the foregoing implementation except for a structure of the bending member. Thus, the same part will be designated by the same reference numeral, and detailed descriptions thereof will be omitted.

Figure 13:
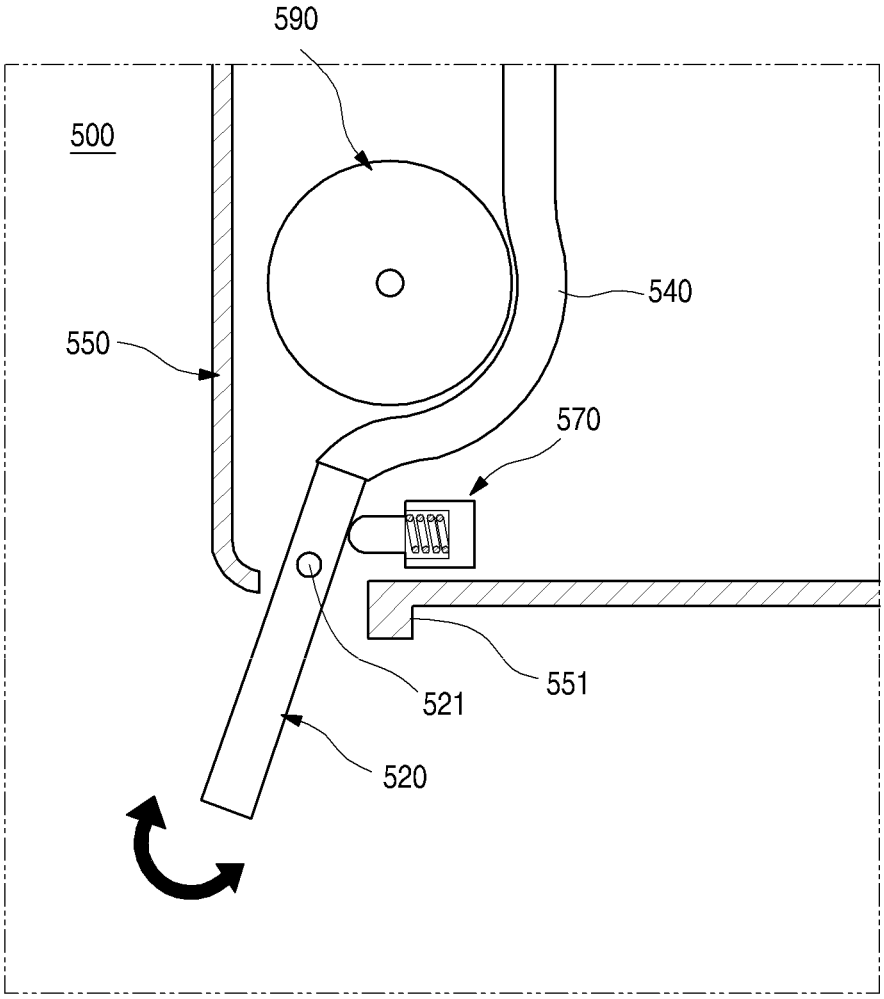
FIG. 13 is a cross-sectional view illustrating an example structure of a dispenser according to a fifth implementation.

FIG. 13 shows a structure of a dispenser according to the fifth implementation.

Referring to FIG. 13, a dispenser 500 according to the fifth implementation includes a water nozzle 520 connected to a water supply hose 540 to dispense water. The water nozzle 520 passes through a top surface of the dispenser 500 to extend downward. Here, a portion of the water nozzle 520 may be covered by a cover 550. The water nozzle 520 may exposed to a lower side of the cover 550.

The water nozzle 520 is rotatably mounted by a rotation shaft 521. The water nozzle 520 may be pulled forward to selectively turn on/off a manipulation detection device 570. A control unit 40 may open a water supply valve 50 according to a signal of the manipulation detection device 570 to supply water.

A stopper 551 may be disposed at a rear side of the water nozzle 520 so that the water nozzle 520 is pulled forward to rotate (in a clockwise direction of FIG. 13). A bending guide 590 for preventing a water supply hose 540 from being bent when the water nozzle 520 is manipulated may be provided.

The bending guide 590 may be disposed at a rear side of a cover 550. Also, the bending guide 590 may be disposed higher than the water nozzle 520 and have a circular plate or cylindrical shape so that the water supply hose 540 is guided along the outside of the bending guide 590. In addition, the bending guide 590 may be mounted rotatable with respect to a center thereof.

Thus, when a user rotates the water nozzle 520, the water supply hose 540 may move along an outer surface of the bending guide 590 to prevent the water supply hose 540 from significantly bent or folded.

Figure 14:
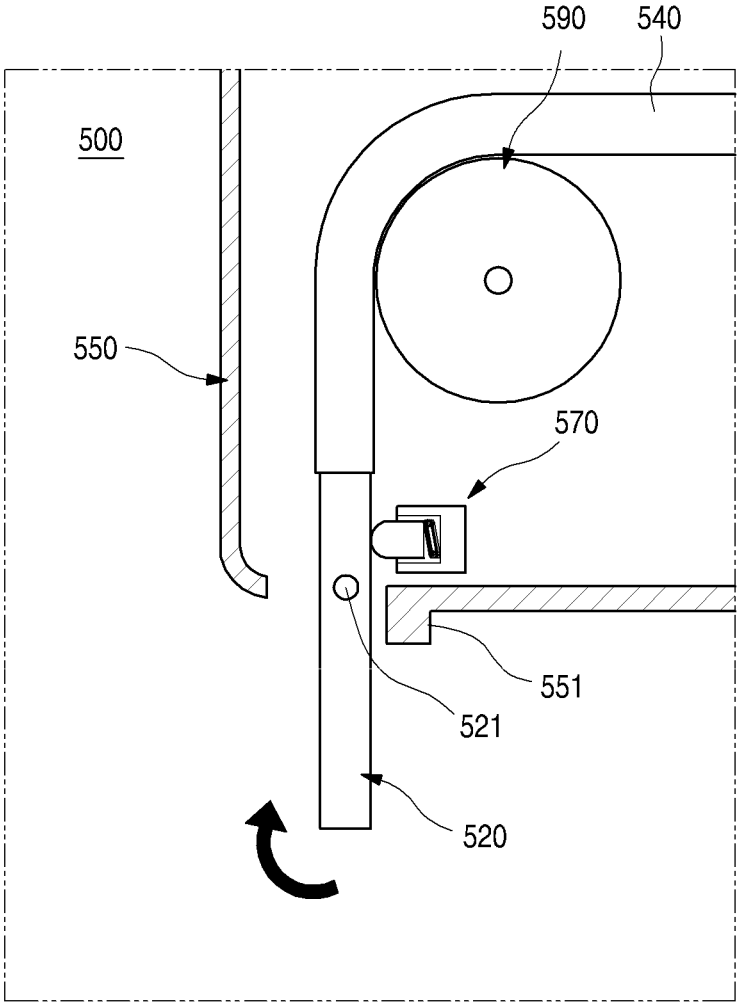
FIG. 14 is a cross-sectional view illustrating an alternative arrangement of a bending guide that is one component of the dispenser.

FIG. 14 shows an alternative arrangement of a bending guide that is one component of the dispenser.

As illustrated in FIG. 14, the water supply hose 540 may pass through one of left and right sides of the bending guide 590. Also, the water supply hose 540 may be maintained in contact with the outer surface of the bending guide 590 and thus may not be bent or folded when the water nozzle 520 is manipulated to smoothly supply water.

In the refrigerator according to the implementations above, the water nozzle may move without separately manipulating the manipulation lever by the user in the state where the water nozzle is disposed inside the cup or container to dispense the water.

Thus, when water is dispensed into the container or bottle having a narrow inlet, since the separate lever manipulation is unnecessary, the user may manipulate the water nozzle by using one hand thereof to dispense the water into the container or bottle, thereby significantly improving convenience in use.

Particularly, in case of the container having the relatively narrow inlet, the dispensed water may be completely introduced into the container without being splashed or supplied to the outside.

Also, in general use, the lever may not be separately manipulated, but rather be intuitively manipulated. Also, in the structure in which the water and ice are dispensed, the manipulation for dispensing the water and ice may be situationally separated to prevent the dispensing manipulation from being confused.

Although implementations have been described with reference to a number of illustrative implementations thereof, it should be understood that numerous other modifications and implementations can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

a main body;

a storage space defined within the main body;

a door configured to open and close at least a portion of the storage space;

a dispenser provided in the door and defining a space in which water is dispensed;

a water nozzle extending downward into the space, the water nozzle being movably mounted at the dispenser and configured to dispense water;

a manipulation detection device provided at the dispenser, the manipulation detection device being configured to detect movement of the water nozzle; and a control unit configured to open and close a water supply valve connected to the water nozzle according to a detection signal generated by the manipulation detection device.

2. The refrigerator according to claim 1, wherein the water nozzle is connected to a flexible water supply hose that is configured to supply water.

3. The refrigerator according to claim 1, wherein an elevation guide configured to guide a vertical movement of the water nozzle is disposed on the dispenser.

4. The refrigerator according to claim 3, wherein the water nozzle includes a hinge that protrudes from the water nozzle, the hinge serving as a rotation shaft of the water nozzle, and wherein the hinge is configured to be guided by the elevation guide.

5. The refrigerator according to claim 3, wherein the water nozzle includes a manipulation handle configured to manipulate a vertical position of the water nozzle.

6. The refrigerator according to claim 3, wherein the manipulation detection device is configured to be activated based on the water nozzle being in a descended position.

7. The refrigerator according to claim 1, wherein the water nozzle extends downward by passing through a top surface of the dispenser.

8. The refrigerator according to claim 1, further comprising a manipulation lever that is configured to cause dispensing of water or ice and that is disposed at a rear portion of the space defined within the dispenser.

9. The refrigerator according to claim 8, wherein the manipulation lever is configured to generate a manipulation signal based on being manipulated, and wherein the control unit is configured to, based on the manipulation detection device being turned on, ignore the manipulation signal of the manipulation lever.

10. The refrigerator according to claim 8, wherein the water nozzle is disposed at a front side of the manipulation lever.

11. The refrigerator according to claim 1, wherein the water nozzle is configured to maintain contact with the manipulation detection device and to return to its initial position by a restoring force of the manipulation detection device.

12. The refrigerator according to claim 1, wherein the water nozzle includes a contact member formed of rubber or urethane and configured to make contact with a container for receiving water.

13. The refrigerator according to claim 1, further comprising a display unit that is configured to output an activated state of the manipulation detection device and that is disposed on the door.

14. The refrigerator according to claim 1, further comprising a chute cover that covers at least a portion of the water nozzle and that is disposed at the dispenser.

15. The refrigerator according to claim 1, further comprising a stopper that is configured to restrict movement of the water nozzle and that is disposed at the dispenser.

16. The refrigerator according to claim 1, further comprising a manipulation part that is configured to selectively manipulate activation of the manipulation detection device and that is disposed at the dispenser.

17. The refrigerator according to claim 1, wherein the dispenser includes an elastic member that is in contact with the water nozzle and configured to return the water nozzle to its initial position by providing an elastic restoring force generated based on a movement of the water nozzle.

18. The refrigerator according to claim 1, further comprising a display unit that is configured to display a manipulation method of the water nozzle and that is disposed at the dispenser.

19. The refrigerator according to claim 1, wherein the water nozzle is disposed at a front side of an ice chute through which ice is dispensed.

20. The refrigerator according to claim 1, wherein an outlet of the water nozzle is disposed under an outlet of an ice chute.

21. The refrigerator according to claim 1, further comprising a manipulation lever that is disposed at the dispenser and that is configured to manipulate the opening and closing of the water supply valve based on the manipulation detection device being turned off.

22. The refrigerator according to claim 1, wherein the water nozzle is rotatably mounted at the dispenser, and the water nozzle is configured to rotate to turn the manipulation detection device on or off.

23. The refrigerator according to claim 1, wherein the water nozzle comprises:

a tube-shaped nozzle including a portion that is exposed to the space within the dispenser, the tube-shaped nozzle being configured to be manipulated via the exposed portion; and a flexible tube-shaped water supply hose connected to an upper end of a manipulation part, the water supply hose being configured to be bent according to a movement of the manipulation part.

24. The refrigerator according to claim 23, further comprising a bending guide that is configured to guide bending of the water supply hose and that is disposed at the dispenser.

25. The refrigerator according to claim 1, wherein the water nozzle is movably mounted at the dispenser and configured to move in a forward-backward direction, further comprising:

a forward-backward movement guide that extends in a forward-backward direction, that is disposed at the dispenser, and that is configured to guide the forward-backward movement of the water nozzle.

* * * * *